US007273087B2

(12) United States Patent
Mulla et al.

(10) Patent No.: US 7,273,087 B2
(45) Date of Patent: Sep. 25, 2007

(54) ASSEMBLY

(75) Inventors: Yusuf Mulla, Batley (GB); Nick Taylor, Shipley (GB)

(73) Assignee: DENSO Marston, Ltd., Shipley, West Yorkshire (GB)

( * ) Notice: Subject to any disclaimer, the term of this patent is extended or adjusted under 35 U.S.C. 154(b) by 94 days.

(21) Appl. No.: 11/211,030

(22) Filed: Aug. 24, 2005

(65) Prior Publication Data

US 2006/0042570 A1 Mar. 2, 2006

(30) Foreign Application Priority Data

Aug. 25, 2004 (GB) ..... 0418887.6

(51) Int. Cl.
*F28F 9/26* (2006.01)

(52) U.S. Cl. ..... 165/71; 165/75

(58) Field of Classification Search ..... 165/71, 165/75, 104.32; 220/367.1; 123/41.54
See application file for complete search history.

(56) References Cited

U.S. PATENT DOCUMENTS

| | | | | | |
|---|---|---|---|---|---|
| 3,004,626 | A * | 10/1961 | Brinen | 165/104.32 |
| 4,723,596 | A * | 2/1988 | Spindelboeck et al. | 165/104.32 |
| 5,230,812 | A * | 7/1993 | Williams | 210/767 |
| 5,353,751 | A * | 10/1994 | Evans | 123/41.01 |
| 5,722,556 | A * | 3/1998 | Ota et al. | 220/367.1 |
| 5,762,130 | A * | 6/1998 | Uibel et al. | 165/71 |
| 5,816,430 | A * | 10/1998 | Gruber | 220/367.1 |
| 2002/0157621 | A1 * | 10/2002 | Lefrancois et al. | 123/41.54 |

* cited by examiner

*Primary Examiner*—Teresa J. Walberg
(74) *Attorney, Agent, or Firm*—Harness, Dickey & Pierce, PLC

(57) ABSTRACT

A tank for a radiator has an integral connecting member between the tank and the radiator. The integral connecting member is used to connect both a filing port and a ventilation port. The filling port is utilized for adding a liquid to the radiator and the ventilation port is utilized for removing gas from the radiator.

14 Claims, 4 Drawing Sheets

ASSEMBLY

FIELD OF THE INVENTION

The present application relates to a tank for a radiator, and particularly to a tank comprising an integral connecting member which can be used to connect to a combined filling and ventilation port. The application also relates to a radiator assembly including such a tank. The tank and radiator assembly may be used in engines, for example engines used in motor vehicles or in generator sets.

BACKGROUND OF THE INVENTION

Radiators are an integral part of engines. They are used to transfer heat from a coolant liquid to the atmosphere, cooling the coolant liquid and allowing its re-circulation.

A typical known radiator assembly is illustrated in FIG. 1. The assembly comprises a radiator core connected to a top tank 2. A header tank 4 (also referred to as an expansion tank) is connected to the top tank 2 by two separate connections. A first connection 6 is provided to allow coolant liquid to flow from the header tank 4 into the top tank 2 and a second connection 8 is provided to allow any gas present in the top tank 2 to escape to the header tank 4.

Typically the two connections 6 and 8 are achieved with two flexible hoses, one between connector 6 and its counterpart and one between connector 8 and its counterpart. Clips are usually required to ensure that the flexible hose is securely attached to the connector.

When used in a vertical configuration, the top tank 2 is completely filled with coolant liquid and the header tank 4 is partially filled with coolant liquid. Thus, there exists an air space in the header tank to accommodate changes in the volume of coolant liquid as its temperature alters during operation of the radiator assembly.

Assemblies of this type use two ports because this results in more efficient operation, particularly during an operation to fill the assembly with coolant liquid. If only a single port is provided for both filling and ventilation then, during filling of the tank, any air escaping from the top tank 2 must flow against the cooling liquid flowing in through the single port. This inhibits smooth filling and venting. The two connector assembly allows a smoother flow since there is a port dedicated for liquid and a port dedicated for ventilation.

A disadvantage of the two port assembly is that the overall complexity is increased due to the need to have two connections.

SUMMARY OF THE INVENTION

The present invention seeks to improve fluid flow in radiator assemblies by exploiting distinct liquid and gas flow in a single connecting member which is an integral part of one of the tanks in the radiator assembly. In particular, the present invention relates to a tank for a radiator assembly comprising an integral connecting member having a first conduit, adapted to allow substantially exclusively coolant liquid to flow into the tank, and a second conduit, adapted to allow substantially exclusively gas to vent out of the tank. The integral connecting member can alternatively have a first conduit, adapted to allow substantially exclusively coolant liquid to flow out of the tank, and a second conduit, adapted to allow substantially exclusively gas to vent into the tank.

According to a first aspect of the present invention, there is provided a tank for a radiator assembly, the tank comprising an integral connecting member for connection to a combined liquid filling and ventilation port, and wherein the integral connecting member comprises:

a connector body having a first end surface adjacent to the port, a second end surface opposite to the first end surface, and a connection surface therebetween;

a first conduit for ventilation extending through the connector body from the first end surface to the second end surface; and a second conduit for liquid flow extending through the connector body from the first end surface to the second end surface, wherein, the first conduit extends beyond the first end surface for a greater distance than the second conduit, and the second conduit extends beyond the second end surface for a greater distance than the first conduit.

The tank of the invention permits a single connection to the combined filling and ventilation port thereby reducing assembly complexity, while retaining the benefits of smooth flow exhibited by conventional two port assemblies. The combined filling and ventilation port may be provided in another tank.

In accordance with the invention, two conduits are provided in a single integral connecting member. In use, the connector body will often be substantially vertical, with the first end surface above the second end surface. At both ends, one conduit extends further beyond the end surface of the connector body than the other conduit, and this means that on each end surface the entrance to one conduit will be lower than the other. The conduit with the lowest entrances will naturally allow liquid flow, whereas the conduit with the highest entrances will allow ventilation. Liquid will travel to the lowest point and therefore use the conduit with the lowest entrances. Likewise, gas will accumulate at the highest point and therefore use the conduit with the highest entrances. Because one end of each conduit extends beyond the respective end surfaces, the ventilation conduit is generally kept clear of liquid and the filling conduit is generally kept free of gas.

A further advantage is that, because the connecting member is formed integrally with the tank, manufacturing complexity can be reduced. The tank and connecting member can be manufactured at the same time.

Preferably, the first conduit does not extend beyond the second end surface. Preferably, the second conduit does not extend beyond the first end surface. This allows the integral connecting member to function as efficiently as possible. If the conduits extended beyond both surfaces not all liquid or gas would be able to flow through the integral connecting member.

Preferably, the tank is made from plastic. The tank can then be manufactured using injection molding. Injection molding allows the integrated connecting member to be manufactured at the same time as the tank. If other materials, such as a metal, are used for the radiator tank it is more difficult to manufacture the integral connecting member.

Preferably, the integral connecting member further comprises a sealing member provided on at least a portion of the connection surface for sealing and connecting the integral connecting member to the combined filling and ventilation port.

The sealing member acts to provide a seal between the integral connecting member and the combined filling and ventilation port when it is located in a corresponding port. The use of a sealing member allows the integral connecting member to be connected simply by inserting into the combined filling and ventilation port.

Preferably, the sealing member is flexible. The sealing member can then allow for variances in manufacturing tolerances, and may also allow relative movement between the integral connecting member and the port. A further advantage is that the quality of the seal is improved because a flexible sealing member can be compressed when it is inserted into a combined filling and ventilation port.

In one embodiment, the sealing member is an 0-ring. This represents a simple, easily manufactured component which can function as the sealing member.

Preferably, the sealing member is adapted to allow relative movement between the integral connecting member and the port, when the integral connecting member is connected to the combined filling and ventilation port. This is useful particularly in engine applications, since as the engine operates various forces may be exerted on the different components of a radiator assembly. It is therefore advantageous if the integral connecting member can accommodate relative movement between itself and the combined filling and ventilation port. This will also allow relative movement between the tank and the combined filling and ventilation port because the integral connecting member is an integral part of the tank.

In one advantageous embodiment, the sealing member comprises:

an annular body adjacent to the connection surface; and a flexible annular projection disposed on the annular body for sealing the connector to the combined filling and ventilation port.

The flexible annular projection will tend to deform in a direction transverse to the plane in which the flexible annular projection defines a circle. This means that the connector can accommodate a greater relative movement in that direction.

According to a second aspect of the invention, there is provided a radiator assembly comprising:

a first tank according to the above described first aspect of the invention; and a second tank in fluid communication with the first tank;

wherein the first tank and the second tank are connected by the integral connecting member.

In one embodiment, the first tank is a radiator tank and the second tank is a header tank. In another embodiment, the first tank is a header tank and the second tank is a radiator tank. The tank comprising an integral connecting member can be used for any tank of a radiator assembly, it is not limited to any particular tank in the assembly.

Such a radiator assembly has reduced manufacturing and assembly costs together with good performance compared with a two-port system because a single connector can give the benefits of a two port connection.

Preferably, the radiator tank comprises a radiator core in fluid communication with a top tank. The top tank can then be connected to the header tank.

Preferably at least a portion of the lower surface of the header tank abuts an upper surface of the radiator tank.

When a radiator assembly is installed in a vertical configuration, a header tank forms the uppermost point of the assembly. If a portion of the lower surface of the header tank abuts an upper surface of the radiator tank, then the vertical space required for the assembly is reduced. This was difficult to achieve in the previous two port system, because additional space for connecting hoses was required.

Preferably, the integral connecting member is disposed such that the first end surface faces the header tank and the second end surface faces the radiator core;

and the first conduit extends beyond the first surface into the header tank for a first distance such that, when the radiator assembly is filled with a normal operating amount of coolant liquid, the first conduit extends above the level of the coolant liquid.

In normal operation, the radiator tank is completely filled with coolant liquid and an additional amount of coolant liquid will be present in the header tank. The header tank will also contain a space to accommodate the expansion of the coolant liquid during use. Thus, "normal operating amount" is used to define a volume of coolant liquid sufficient to completely fill the radiator tank, and partially fill the header tank. If the first conduit extends above the normal level of coolant liquid in the header tank, then the ventilation port is shielded from the liquid in the header tank so that gas can flow more freely through it.

According to a third aspect of the invention, there is provided an engine including the radiator assembly as defined in the above described second aspect.

According to a fourth aspect of the present invention, there is provided a motor vehicle incorporating an engine according to the above described third aspect of the invention.

According to a fifth aspect of the present invention, there is provided a generator set incorporating an engine according to the above described third aspect of the invention.

The radiator assembly is particularly well suited for application in engines and any application in which space is limited. The use of a single integral connecting member simplifies manufacturing costs and allows the header tank to be located directly on top of a radiator tank, with no need for additional connecting hoses. Furthermore, this simple connection allows the performance of previous two connection systems to be retained.

The tank with an integrated connection member can also be used in any situation in which it is desired to both fill and vent a container.

The second conduit may extend beyond the first end surface. The first conduit may extend beyond the second end surface. Preferably however the second conduit is substantially flush with the first end surface. Preferably however the first conduit is substantially flush with the second surface.

The integral connecting member may be connected to a hose, or connected directly to a corresponding filling and ventilation port by simply pressing them together, using a screw fit, or using an interference fit.

DETAILED DESCRIPTION OF THE PREFERRED EMBODIMENTS

Embodiments of the invention will now be described by way of example only with reference to accompanying drawings 2 to 5.

Figure 1:
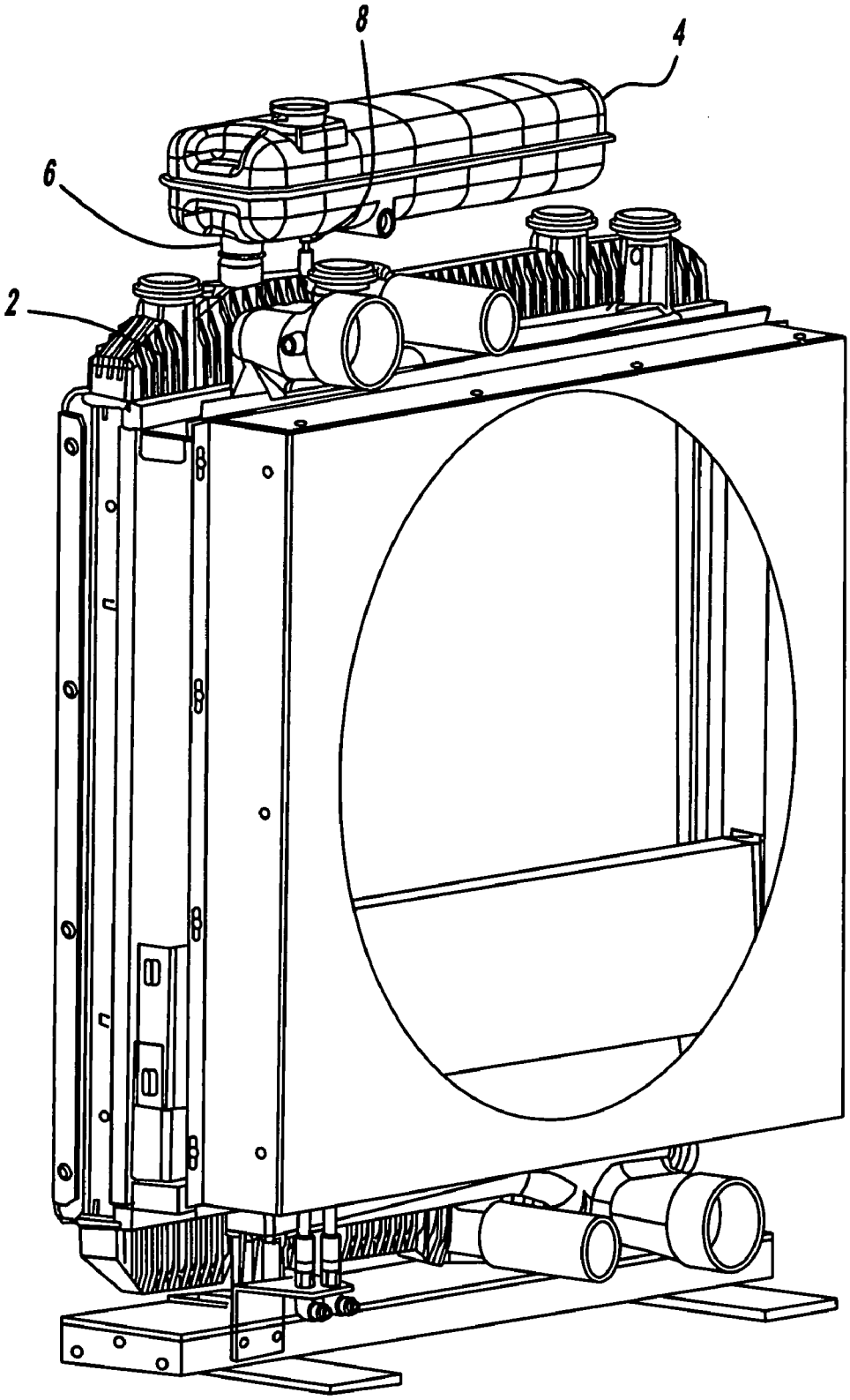
FIG. 1 is a typical radiator assembly.
Figure 2:
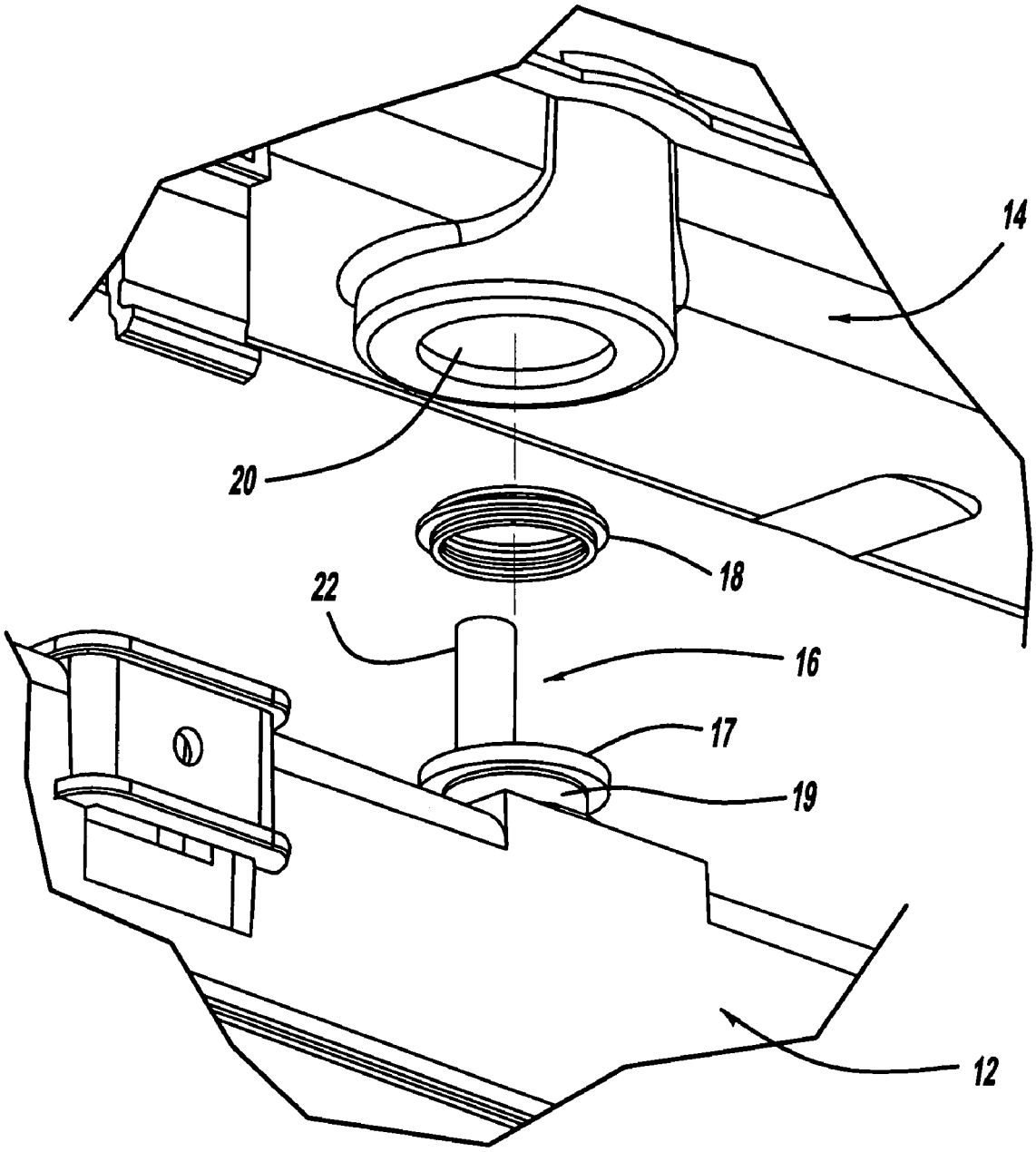
FIG. 2 is an exploded view of a radiator assembly according to an exemplary embodiment of the present invention.

FIG. 2 depicts an exploded view of an exemplary embodiment of a radiator assembly according to the present invention. The assembly comprises a radiator tank 12 (shown only partially in FIG. 2) and a header tank 14 (also shown only partially in FIG. 2). The two tanks 12 and 14 are connected by an integral connecting member 16 formed as an integral part of the radiator tank 12. The integral connecting member 16 has a connector body 17 with a connection surface 19. A sealing member 18 is mounted on the connector body 17 and ensures a liquid tight seal between the integral connecting member 16 and a corresponding liquid filling and ventilation port 20 provided in the header tank 14.

Figure 3:
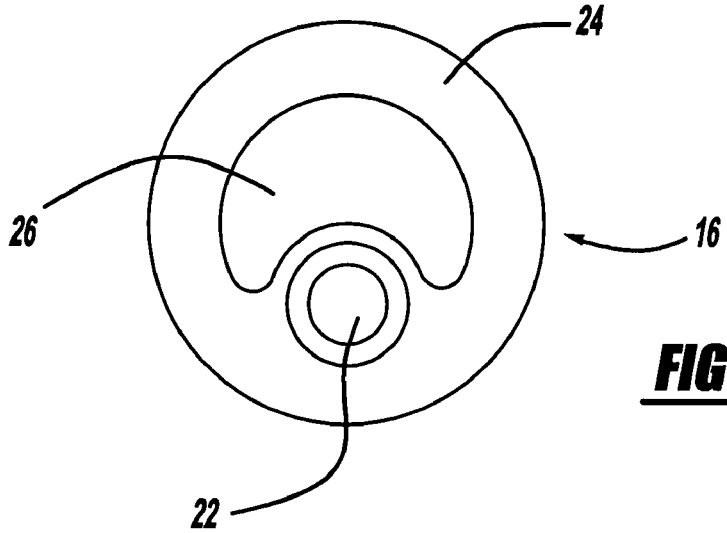
FIG. 3 depicts a plan view of an integral connecting member according to an exemplary embodiment of the present invention.

As is best shown in FIG. 3 in plan view from the viewpoint of the liquid filling and ventilation port 20, the integral connecting member 16 comprises first and second conduits 22,26 which travel through the connector body 17 of the integral connecting member 16. The first conduit 22 is used for ventilation and the second conduit 26 is used for liquid flow. It can be seen that the wall of the first conduit 22 extends above an external end surface 24 of the connector body 17 (as is also shown in FIG. 2). The second conduit 26 terminates flush with the external end surface 24.

The diameter of the second conduit 26 is greater than the diameter of the first conduit 22. However, the precise diameter chosen and relative diameters will depend on the particular application.

Figure 4:
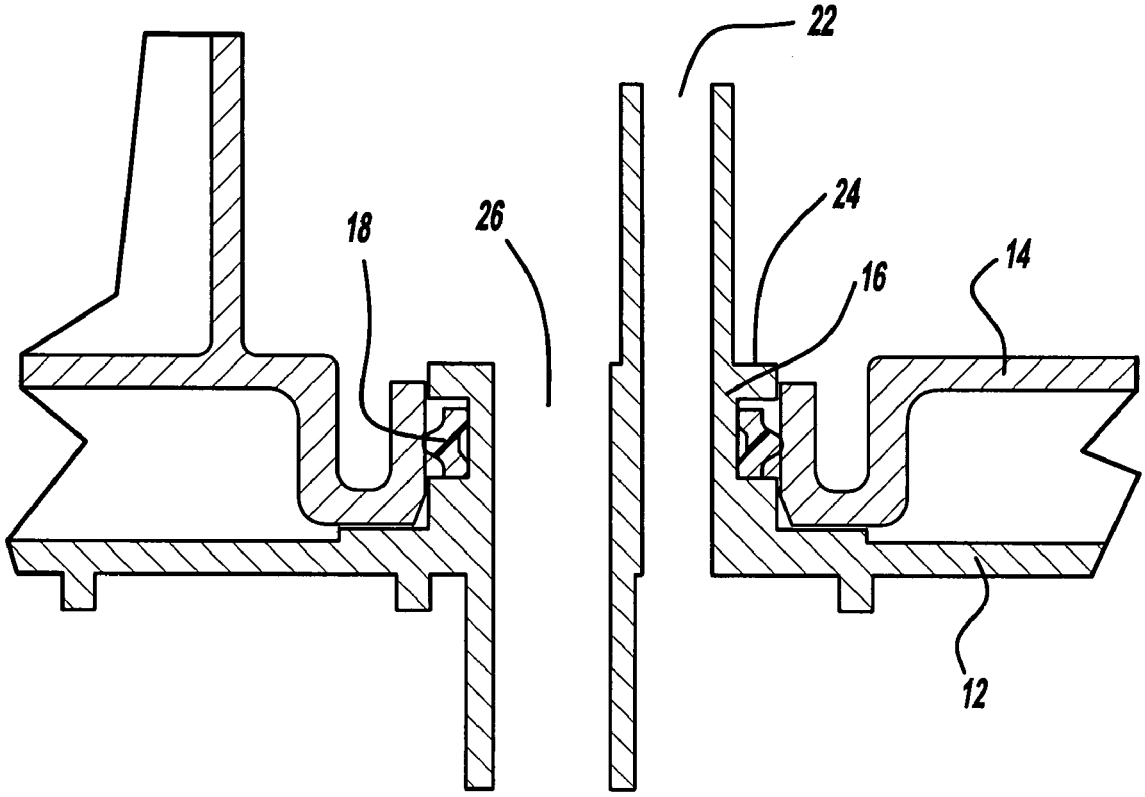
FIG. 4 depicts a cross section of a tank including an integrated connecting member and a corresponding port in the assembled position, according to an exemplary embodiment of the present invention.

FIG. 4 illustrates a cross section of a part of the radiator assembly including the integrated connecting member 16 in the assembled position. The header tank 14 has been pressed onto the radiator tank 12 until a portion of the lower surface of the header tank 14 abuts a portion of the upper surface of the radiator tank 12. The sealing member 18 provides an air and liquid tight seal between the header tank 14 and the radiator tank 12.

The inner diameter of the port 20 in the header tank 14 is slightly greater than the outer diameter of the connector body 17. This allows the integral connecting member 16 to be easily inserted into the port 20. The sealing between the connector 16 and the port 20 is achieved by deformation of the sealing member 18.

In this embodiment, the header tank 14 and the radiator tank 12 are all manufactured from plastic, for example a synthetic polyamide such as that sold under the mark Nylon. It is advantageous for the radiator tank 12 with the integrated connecting member 16 to be formed from plastic because it can then be manufactured using injection molding. The sealing member 18 is manufactured from a flexible material, for example an elastomer or rubber.

Figure 5:
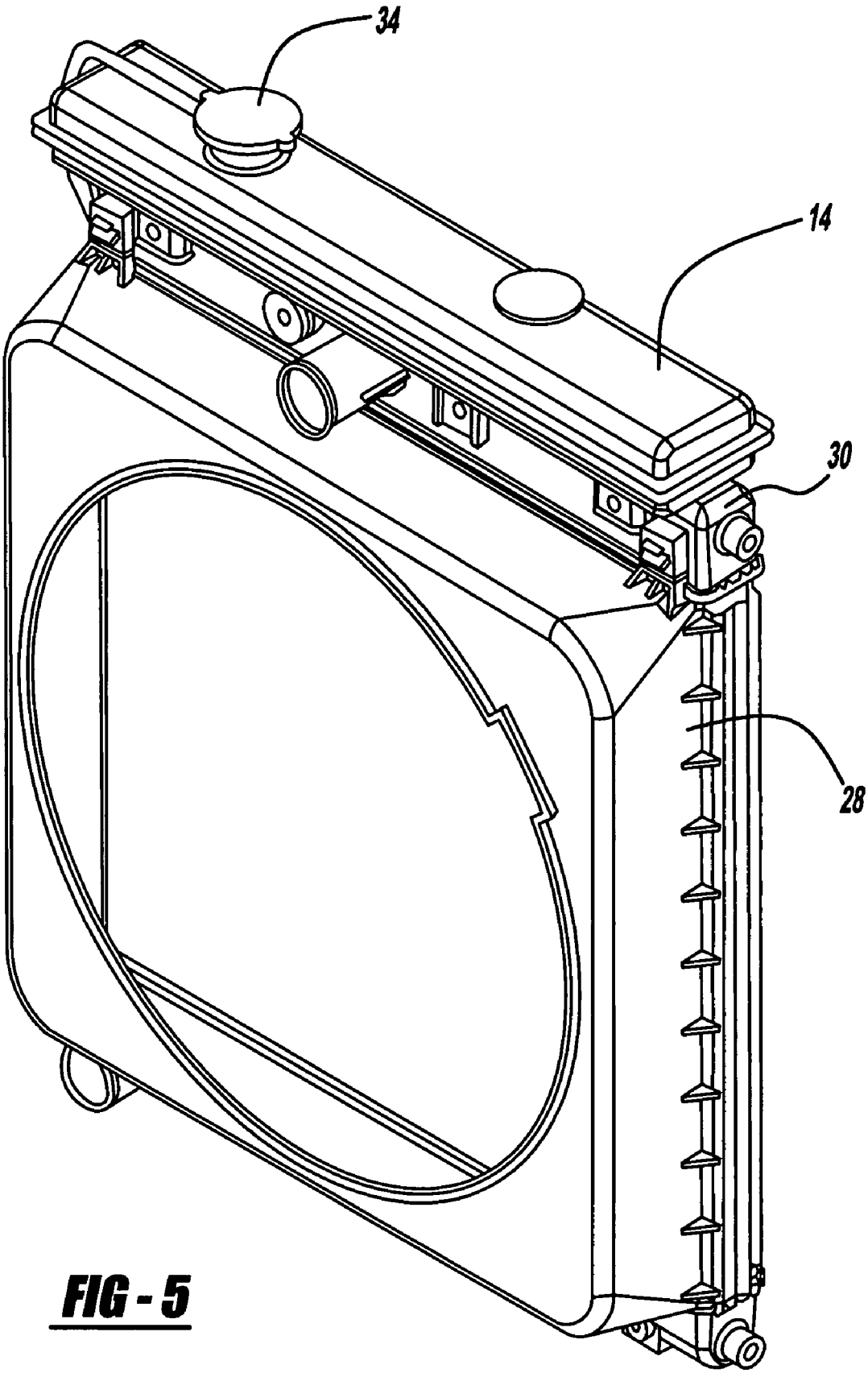
FIG. 5 depicts a perspective view of a radiator assembly according to an exemplary embodiment of the present invention.

FIG. 5 shows a perspective view of the radiator assembly in the assembled position. The radiator assembly has a radiator core 28 which is attached to a top tank 30. The radiator core 28 and top tank 30 together form the radiator tank 12 discussed in relation to FIGS. 2 to 4. A header tank 14 is connected to the top tank 30. The use of the single integral connecting member 16 allows the header tank 14 to rest substantially on top of the top tank 30. The vertical space taken up by the assembly is therefore minimized. Furthermore, because the integral connecting member 16 is an integral part of the top tank 30 and is attached directly to the header tank 32, there is no need for additional hoses or connecting clips.

In use, the radiator assembly is filled with a coolant liquid via a port 34 provided in the header tank 14. The liquid gathers at the bottom of the header tank 14 under the action of gravity. It then flows through the second conduit 26 provided in the connector 16. During this filling phase, the liquid flows freely downwards into the top tank 30 and radiator core 28. The first conduit 22 for ventilation remains substantially free of liquid because of the extension of its walls above the upper entrance to the second conduit 26.

Furthermore, because the lower entrance to the first conduit 22 is higher than the lower entrance of the second conduit 26, air which is displaced from the radiator core 28 and top tank 30 during filling will naturally pass through the first conduit 22 for ventilation without encountering any liquid which could otherwise obstruct its flow.

The assembly is filled to a point at which a small amount of liquid remains in the expansion tank 32. Therefore the radiator core 28 and top tank 30 are substantially entirely filled with liquid. The header tank 32 contains an air space which allows for expansion of the coolant liquid as it heats during operation of the radiator.

This application is based on and incorporates herein by reference United Kingdom Patent Application No. 0418887.6 filed Aug. 25, 2004.

The invention claimed is:

1. A tank for a radiator assembly, the tank comprising:

an integral connecting member for connection to a combined liquid filling and ventilation port, and wherein the integral connecting member comprises:

a connector body having a first end surface adjacent to the port, a second end surface opposite to the first end surface, and a connection surface therebetween;

a first conduit for ventilation extending through the connector body from the first end surface to the second end surface; and a second conduit for liquid flow extending through the connector body from the first end surface to the second end surface, wherein, the first conduit extends beyond the first end surface for a greater distance than the second conduit, and the second conduit extends beyond the second end surface for a greater distance than the first conduit;

wherein the integral connecting member further comprises a sealing member provided on at least a portion of the connection surface for sealing and connecting the integral connecting member to the combined filling and ventilation port wherein the sealing member is adapted to allow relative movement between the integral connecting member and the port, when the integral connecting member is connected to the combined filling and ventilation port.

2. A tank for a radiator assembly, the tank comprising:

an integral connecting member for connection to a combined liquid filling and ventilation port, and wherein the integral connecting member comprises:

a connector body having a first end surface adjacent to the port, a second end surface opposite to the first end surface, and a connection surface therebetween;

a first conduit for ventilation extending through the connector body from the first end surface to the second end surface; and a second conduit for liquid flow extending through the connector body from the first end surface to the second end surface, wherein, the first conduit extends beyond the first end surface for a greater distance than the second conduit, and the second conduit extends beyond the second end surface for a greater distance than the first conduit;

wherein the integral connecting member further comprises a sealing member provided on at least a portion of the connection surface for sealing and connecting the integral connecting member to the combined filling and ventilation port wherein the sealing member comprises:

an annular body adjacent to the connection surface; and a flexible annular projection disposed on the annular body for sealing the integral connecting member to the combined filling and ventilation port.

3. A radiator assembly comprising:

a first tank comprising an integral connecting member for connection to a combined liquid filling and ventilation port, and wherein the integral connecting member comprises:

a connector body having a first end surface adjacent to the port, a second end surface opposite to the first end surface, and a connection surface therebetween;

a first conduit for ventilation extending through the connector body from the first end surface to the second end surface;

a second conduit for liquid flow extending through the connector body from the first end surface to the second end surface; and a second tank in fluid communication with the first tank; wherein the first conduit extends beyond the first end surface for a greater distance than the second conduit, and the second conduit extends beyond the second end surface for a greater distance than the first conduit; and the first tank and the second tank are connected by the integral connecting member.

4. A radiator assembly according to claim 3, wherein the first tank is a radiator tank and the second tank is a header tank.

5. A radiator assembly according to claim 3, wherein the first tank is a header tank and the second tank is a radiator tank.

6. A radiator assembly according to claim 4, wherein the radiator tank comprises a radiator core in fluid communication with a top tank.

7. A radiator assembly according to claim 4, wherein at least a portion of a lower surface of the header tank abuts an upper surface of the radiator tank.

8. A radiator assembly according to claim 4, wherein the integral connecting member is disposed such that the first end surface faces the header tank and the second end surface faces the radiator tank; and the first conduit extends beyond the first surface into the header tank for a first distance such that, when the radiator assembly is filled with a normal operating amount of coolant liquid, the first conduit extends above the level of the coolant liquid.

9. An engine incorporating a radiator assembly according to claim 3.

10. A motor vehicle incorporating an engine according to claim 9.

11. A generator set incorporating an engine according to claim 9.

12. A radiator assembly according to claim 5, wherein the radiator tank comprises a radiator core in fluid communication with a top tank.

13. A radiator assembly according to claim 5, wherein at least a portion of a lower surface of the header tank abuts an upper surface of the radiator tank.

14. A radiator assembly according to claim 5, wherein the integral connecting member is disposed such that the first end surface faces the header tank and the second end surface faces the radiator tank; and the first conduit extends beyond the first surface into the header tank for a first distance such that, when the radiator assembly is filled with a normal operating amount of coolant liquid, the first conduit extends above the level of the coolant liquid.

* * * * *